US008829317B1

(12) United States Patent
Linquist

(10) Patent No.: US 8,829,317 B1
(45) Date of Patent: Sep. 9, 2014

(54) WRIST ALIGNMENT DEVICE FOR STRINGED MUSICAL INSTRUMENTS

(71) Applicant: Michelle Darlene Linquist, Dallas, TX (US)

(72) Inventor: Michelle Darlene Linquist, Dallas, TX (US)

(73) Assignee: Harmonious Designs, LLC, Dallas, TX (US)

( * ) Notice: Subject to any disclaimer, the term of this patent is extended or adjusted under 35 U.S.C. 154(b) by 0 days.

(21) Appl. No.: 13/834,376

(22) Filed: Mar. 15, 2013

(51) Int. Cl.
*G10D 1/02* (2006.01)
*G10D 3/18* (2006.01)

(52) U.S. Cl.
CPC ..... *G10D 3/18* (2013.01)
USPC ..... 84/281; 84/280

(58) Field of Classification Search
USPC ..... 84/281, 280
See application file for complete search history.

(56) References Cited

U.S. PATENT DOCUMENTS

| | | | | | |
|---|---|---|---|---|---|
| 542,278 | A * | 7/1895 | Petermann | ..... | 84/281 |
| 776,434 | A * | 11/1904 | Smith | ..... | 84/281 |
| 896,721 | A * | 8/1908 | Goldenberg | ..... | 84/281 |
| 1,271,460 | A * | 7/1918 | Handel | ..... | 84/281 |
| 1,740,824 | A * | 12/1929 | Von Linprun | ..... | 84/281 |
| 1,753,006 | A * | 4/1930 | Haaf | ..... | 84/328 |
| 1,824,901 | A * | 9/1931 | Kessler | ..... | 84/281 |
| 1,886,070 | A * | 11/1932 | Weber | ..... | 84/281 |
| 1,906,584 | A * | 5/1933 | Hays | ..... | 84/281 |
| 2,056,819 | A * | 10/1936 | Bodee | ..... | 84/281 |
| 2,240,696 | A * | 5/1941 | Gusman | ..... | 84/281 |
| 2,761,346 | A * | 9/1956 | Kuchler et al. | ..... | 84/281 |
| 3,619,470 | A * | 11/1971 | Harris | ..... | 84/281 |
| 3,726,176 | A * | 4/1973 | Kaplan | ..... | 84/470 R |
| 4,913,027 | A * | 4/1990 | Twohy | ..... | 84/280 |
| 7,615,698 | B2 * | 11/2009 | Woodhouse | ..... | 84/281 |
| 7,897,857 | B2 * | 3/2011 | Lockwood | ..... | 84/280 |
| 2008/0271585 | A1 * | 11/2008 | Jones | ..... | 84/281 |

* cited by examiner

*Primary Examiner* — Robert W Horn

(57) ABSTRACT

A wrist alignment device for attachment to a stringed musical instrument, the instrument comprising a neck portion comprising a fingerboard on one side of the neck portion and a nose portion contiguous with the neck portion, the device comprising a three-dimensional oblong body comprising a flat planar end and curved sides, the body removably attachable to a side of the neck portion that is opposite the side comprising the fingerboard and at an area where the neck and the nose portion meet, the device sized to come into contact with a ball portion of the hand of a player of the instrument, placing the wrist in a perpendicular position relative to the neck without inhibiting rotation of the wrist as is necessary for proper placement of the fingers on the finger board.

8 Claims, 2 Drawing Sheets

WRIST ALIGNMENT DEVICE FOR STRINGED MUSICAL INSTRUMENTS

BACKGROUND OF THE INVENTION

The disclosed invention is directed generally to devices that help promote proper hand posture in use of a musical instrument and more specifically to devices directed to promoting an ergonomic (vertical) alignment of the wrist-to-hand posture of a player of a stringed instrument such as but not limited to a violin.

Maintaining the correct wrist posture is critical when playing an instrument such as the violin, viola or fiddle as it affects a player's ability to reach all of the strings on the fingerboard and the ability to perform more advanced playing techniques such as vibrato. The ideal position of a player's wrist is upright, meaning approximately in a vertical, linear alignment between the player's left hand and left forearm. Disclosed is a device that inhibits the player's ability to collapse his/her wrist against the neck of the instrument, a condition commonly referred to as "pizza hand" or "waiter hand." A player, especially a novice, is tempted to adopt a pizza hand posture for the wrist, to support the instrument's neck similar to the wrist-hand posture adopted by a waiter carrying a tray. However, a pizza hand is not desired for ergonomic reasons and for the reason that such a posture inhibits a player's ability to reach the strings of the instrument. The majority of a player's time is spent in independent practice and outside of the traditional lesson setting with an instructor present who can prompt the player to correct and adopt the preferred wrist-hand posture. Time spent in independent practice creates a risk of learning the incorrect posture which then needs to be corrected or re-taught in lessons.

U.S. Pat. No. 7,897,857 to Lockwood entitled "Self-Corrective Wrist Positioning Practice Device" is directed to a device that is placed on the hand and forearm of the player. The device employs negative reinforcement to promote proper wrist alignment by physically applying pressure to the player's forearm and hand area potentially causing discomfort and irritation. The known device which offers an invasive solution is not readily independently usable by very young players because of its manner of attachment and the use of the device may require the assistance of an adult instructor who will place, adjust the device properly.

Thus what is needed is a device that promotes the teaching and/or learning of a proper wrist alignment for a player of a stringed instrument where the device is simple in construction, relatively inexpensive to construct, easy to use, easy to remove and re-place on demand, delivers a non-invasive solution and is amenable for use by players of any age. The disclosed invention may be understood with the help of the disclosure below and including the attached drawings.

SUMMARY OF THE INVENTION

The present invention relates to training, promoting or correcting the wrist posture of players of instruments such as for example and not by way of limitation the violin, viola and fiddle. The device is designed for attachment to the instrument and not the player's hand as per known prior art. The disclosed wrist alignment device promotes approximately vertical alignment of the player's left wrist while allowing rotation of the wrist as needed for finger placement on the fingerboard of the instrument. It is noted that in this disclosure the term 'ball of the hand' refers to the fleshy, rounded portion of the hand that is located approximately between the base of the thumb and the wrist. Thus, in accordance with a preferred embodiment of the disclosed invention, described is a wrist alignment system for attachment to a stringed musical instrument comprising in combination a device comprising a three-dimensional oblong body comprising a flat planar end, at least one magnet inside of the oblong body recessed beneath the planar end, at least one second magnet inside of the body and recessed from a side portion of the oblong body, at least one third magnet removably attachable to a nose portion of the instrument, at least one fourth magnet removably attachable to a side of the neck that is opposite a side of the neck of the instrument comprising a fingerboard and near the nose, the at least one third magnet and the at last one fourth magnet having an axial magnetization that is opposite that of the axial magnetization of the at least one first magnet and the at least one second magnet such that placing the device in contact with the third and fourth magnets attaches the device to the instrument, wherein the device places the player's left wrist in substantially vertical alignment with a left forearm of the player and allows rotation of the wrist for placement of the player's fingers on the fingerboard.

The three-dimensional oblong body is preferably constructed from extruded or expandable polystyrene foam (e.g., Styrofoam) or similar lightweight material and is sized and adapted to be smooth so to come in gentle and non-invasive contact with the ball of the player's hand. The oblong shape is the preferred shape for the intended purpose and approximates the shape of a vertical cross-sectional cut of an egg-shaped body where the body rests on its side (as opposed to on the egg-shaped body's roughly 'pointed' top end or the 'fat' bottom end). The size of the three dimensional oblong body is adapted for the size of the instrument and the size of the ball of the player's hand such that the oblong device allows the ball of the player's hand to come into contact with the oblong, rounded portion of the body of the device while allowing the player's fingers to properly reach all of the strings. By way of illustration and not by way of limitation, the wrist alignment device is roughly sized to comprise a ¼ to ¾ vertical cut of an oblong, or substantially egg-shaped three-dimensional body where the egg-shaped body rests on its side (meaning that the 'more pointed' end is on one side and the 'fatter bottom' end is at the other side) to create a flat planar end and a rounded, oblong end portion. By way of example and not by limitation, the cut for the oblong shaped three-dimensional body when used with a violin may preferably be between 1.688 and 3.375 inches in length and from 0.875 to 2.125 inches in height, when measuring from the outermost point of the rounded end to the planar flat end. The vertical cut portion used per the disclosed preferred embodiment is the one comprising the 'fatter bottom' end of the egg-shaped body (as shown in FIG. 8 described below). The number of magnets utilized may vary depending upon the degree of 'snap' desired and the size of the device and the size of the magnets.

The applicant has experimented with various shapes of axially magnetized magnets, including curved (or arc) magnets, block (rectangular) magnets and disc-shaped magnets. Per a preferred embodiment for a larger size wrist alignment device adapted for larger instruments and larger player hands, the magnets utilized are preferably the curved type. One reason noted for this is that the curved design is adapted well for more secure and stable attachment of the magnet to the neck and nose sections of the stringed instrument. Per an alternative embodiment for a smaller sized device for smaller instruments and smaller player hands, the non-curved axially magnetized magnets may preferably be used.

The disclosed preferred means of attachment of the wrist alignment device to the musical instrument is thus adapted to allow for quick (e.g. 'snap' in place) attachment and removal from the instrument. The magnets that serve to keep the device attached to the instrument allow for the ready, on demand removal of the device from the instrument to allow for play without the aid of the wrist alignment device such that the player and/or instructor can observe the degree of the player's 'learning' of the proper wrist posture. If it is found that the player needs more time to learn the proper wrist posture the magnets can be replaced on the instrument and the device placed properly in contact with the magnets (realigned to "snap" the device back in place). An alternative embodiment, one for example that does not utilize magnets and merely utilizes a Velcro system for removably attaching the device to the instrument is also possible and may be utilized depending upon the preference of the user and such manner of attachment is known to those with ordinary skill in the relevant art. It is obvious to one of ordinary skill in the relevant art that alternative designs for the attachment of the disclosed device to the instrument is possible and is deemed to be within the scope of the disclosed invention.

The device is attached to the neck of the instrument on the side of the neck that is opposite the fingerboard and in the area near the nose of the instrument where the neck and nose meet. The magnets attached to the neck and nose are preferably each wrapped in an adhesive cloth and the preferred manner of attachment to the instrument is via an adhesive loop Velcro® and an adhesive foam strip combination. A side of the oblong body of the device rests against and is attached to the nose of the instrument and the flat planar end of the device comes in contact with the neck of the instrument, both areas of the device held in place via the magnetic attraction of the sets of axially magnetized magnets inside of the device and on the neck and nose respectively. Thus, for example the 'south side' magnets attached to the neck and nose of the instrument are covered by adhesive cloth and lined up roughly in parallel to the location of the 'north side' magnets that are inset inside of the oblong body of the wrist alignment device.

The oblong body of the device is sized and shaped to come into contact with the ball of the left hand of the player thus serving as a non-invasive, consistent guide for holding the wrist in an upright position during instrument play and inhibiting "pizza hand." The size of the disclosed wrist alignment device, and the component parts used in the manner of attachment of the device to the instrument, is dependent upon the size of the instrument, the expected width of the player's left thumb pad, and the anticipated size or length of the ball of the left hand, where that is defined as the rounded area of the palm located between the base of the thumb and the wrist.

DETAILED DESCRIPTION OF THE DRAWINGS

Figure 1:
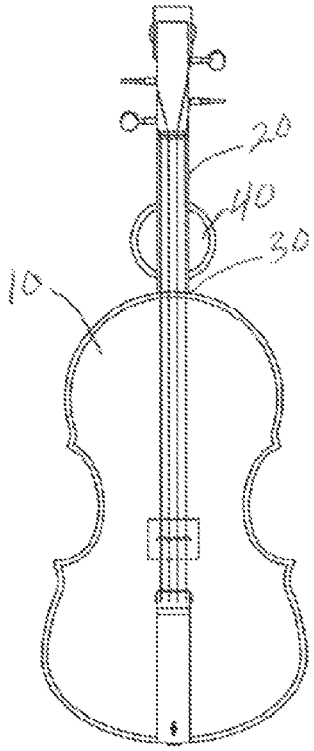
FIG. 1 is a top elevational perspective of a violin having the disclosed wrist alignment device attached.

FIG. 1 is a top elevational perspective of a violin 10 comprising a neck 20, a nose 30 having the disclosed wrist alignment device 40 attached.

Figure 2:
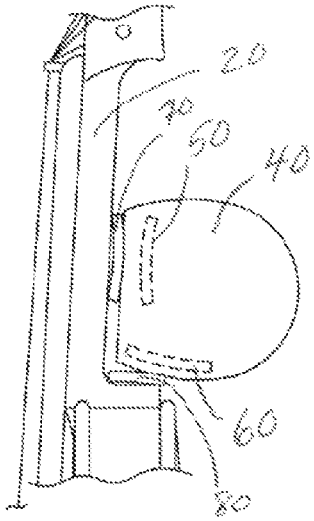
FIG. 2 is a side perspective of a violin having the preferred embodiment per a larger size of the disclosed wrist alignment device attached.

FIG. 2 is a side perspective of a violin 10 having attached the preferred embodiment per a larger size of the disclosed wrist alignment device. The wrist alignment device 40 is attached to the neck 20 on the side of the neck that is opposite of the fingerboard, and near the nose 30. Shown is the wrist alignment device 40 comprising a magnet 50 inset recessed beneath the flat planar side of the oblong body 45, a magnet inset recessed from a side wall of the oblong device, a magnet 80 attached at the nose of the instrument and a magnet 70 attached to the neck 20 of the instrument. It is noted that, for simplicity, the drawings do not show the adhesive cloths that preferably cover and wrap the magnet(s) that are attached to the neck of the instrument, the magnet(s) that are attached at the nose of the instrument, and the oblong-shaped wrist alignment device itself. It is noted also that for convenience only the drawings do not show the Velcro (or similar)-type system that is preferably utilized to removably attach the magnets to the instrument.

Figure 3:
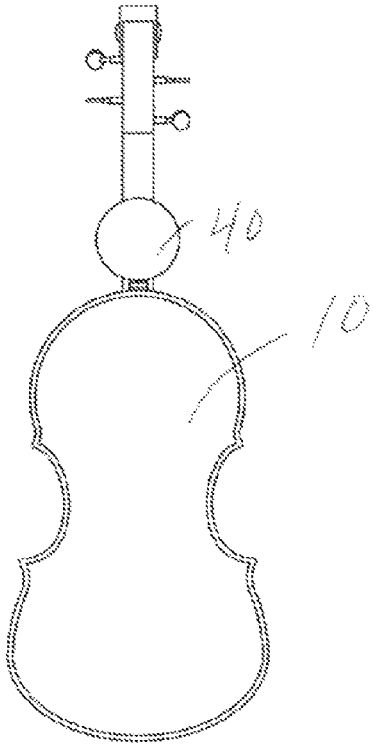
FIG. 3 is a bottom perspective of a violin with the disclosed wrist alignment device attached.

FIG. 3 is a bottom perspective of a violin 10 with the disclosed wrist alignment device 40 attached to the area approximately where the neck and the nose meet. It is noted that while the diagram shows a circular outline for the wrist alignment device, as explained above the outline is actually more oblong in shape per the preferred embodiment of the wrist alignment device.

Figure 4:
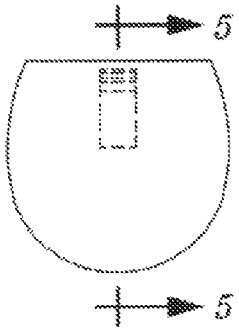
FIG. 4 is a side elevational view of the oblong body of the disclosed wrist alignment device.
Figure 5:
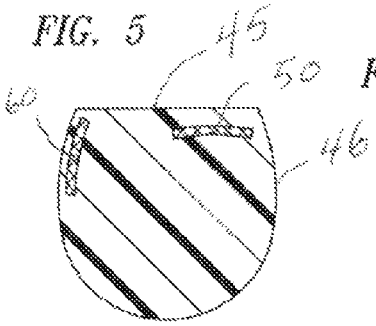
FIG. 5 is a cross-sectional view of the oblong body of the disclosed wrist alignment device.
Figure 8:
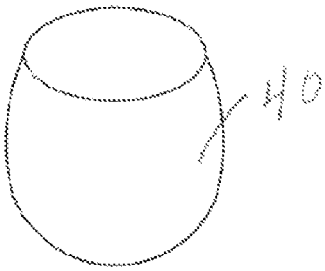
FIG. 8 is a side perspective of the oblong body of the disclosed wrist alignment device.
Figure 6:
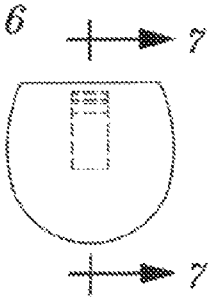
FIG. 6 is a side elevational view of the oblong body of a smaller size embodiment of the disclosed wrist alignment device.
Figure 7:
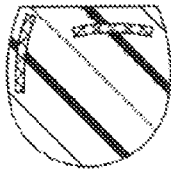
FIG. 7 is a cross-sectional view of the oblong body of a smaller size embodiment of the disclosed wrist alignment device.
Figure 10:
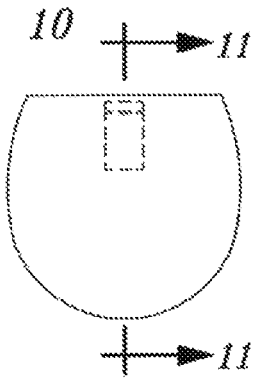
FIG. 10 is a side elevational view of an alternative embodiment of the disclosed wrist alignment device
Figure 11:
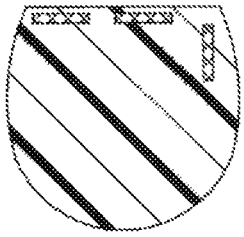
FIG. 11 is cross-sectional view of an alternative embodiment of the disclosed wrist alignment device.
Figure 12:
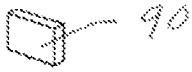
FIG. 12 shows a side elevational perspective of a block or rectangular-shaped magnet used per an alternative embodiment.
Figure 13:
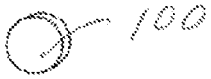
FIG. 13 shows a front perspective of a disc-shaped magnet used per an alternative embodiment of the disclosed wrist alignment device

FIGS. 4 and 5 show side elevational and cross-sectional views of a preferred embodiment of the disclosed wrist alignment device. Thus shown is a curved or arc-shaped first magnet 50 inset and recessed inside of and beneath the flat planar end 45 of the oblong body of the device, the rounded portion 46 of the oblong body of the device, a second magnet 60 inset and recessed away from the first magnet and on a side of the oblong-body. FIGS. 10 and 11 show how depending upon the size of the device more than one magnet may be inset and recessed beneath the planar end. As shown in FIG. 11, placement of two (2) magnets inset and recessed from the flat planar end of the wrist alignment device is preferable for larger size embodiments of the wrist alignment device. FIG. 8 shows the general shape of the disclosed wrist alignment device and shows the flat planar end 45 and the rounded, oblong-shaped end 40.

Figure 9:
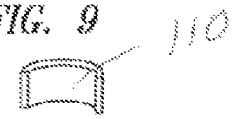
FIG. 9 is a front perspective of a curved magnet used per a preferred embodiment of the disclosed wrist alignment device for a larger size instrument.

FIG. 9 shows a curved or arc-shaped magnet per the preferred embodiment of the disclosed device. It is noted that the arc-shaped magnets are preferably placed in a horizontal orientation (as shown in FIG. 9) inside the oblong body and the horizontal orientation is also used for the curved magnets attached to the neck and nose of the instrument respectively.

The drawings used to teach the disclosed invention show a violin per a preferred embodiment. As stated above, the disclosed wrist alignment device and system are suitable also for use with a viola, fiddle and/or other similar instruments and such disclosure is deemed to be within the scope of this invention. It is noted that the disclosed wrist alignment device, the wrist alignment system may be sold and distributed separately or alternatively in combination with a stringed instrument, such as for example in a package comprising a beginner violin.

I claim:

1. A wrist alignment device for attachment to a stringed musical instrument, the instrument comprising a neck portion comprising a fingerboard on one side of the neck portion and a nose portion contiguous with the neck portion, the device comprising a three-dimensional substantially oblong body comprising a flat planar end and a rounded portion, the device removably attachable to a side of the neck portion that is opposite the side comprising the fingerboard and at an area where the neck portion and the nose portion meet, the device sized such that the rounded portion comes into contact with a ball portion of the hand of a player of the instrument promoting a vertical alignment of the wrist and the player's forearm and without inhibiting rotation of the wrist needed for proper placement of the player's fingers on the fingerboard.

2. The wrist alignment device per claim 1 wherein the musical instrument is a violin.

3. The wrist alignment device per claim 1 wherein the musical instrument is a viola.

4. The wrist alignment device per claim 1 wherein the musical instrument is a fiddle.

5. The wrist alignment device per claim 1 wherein the device is constructed of Styrofoam.

6. A wrist alignment system for attachment to a stringed musical instrument comprising in combination a device comprising a three-dimensional oblong body comprising a flat planar end, at least one magnet inside of the oblong body recessed beneath the planar end, at least one second magnet inside of the body and recessed from a side portion of the oblong body, at least one third magnet removably attachable to a nose portion of the instrument, at least one fourth magnet removably attachable to a side of the neck that is opposite a side of the neck of the instrument comprising a fingerboard and near the nose, the at least one third magnet and the at last one fourth magnet having an axial magnetization that is opposite that of the axial magnetization of the at least one first magnet and the at least one second magnet such that placing the device in contact with the third and fourth magnets attaches the device to the instrument, wherein the device places the player's left wrist in substantially vertical alignment with a left forearm of the player and allows rotation of the wrist for placement of the player's fingers on the fingerboard.

7. The system per claim 6 in combination with a violin.

8. A method for teaching the proper wrist alignment of a stringed musical instrument comprising the steps of:

providing a wrist alignment device comprising an oblong three-dimensional body comprising a flat planar end, at least on magnet inside of the oblong body recessed beneath the planar end, at least on second magnet inside of the body and recessed from a side portion of the oblong body, removably attaching at least on third magnet to a nose portion of the instrument, removably attaching at least one fourth magnet to a neck of the instrument on the side of the neck that is opposite the fingerboard and near the nose of the instrument, the at least one third magnet and the at least one fourth magnet having an axial magnetization that is opposite that of the axial magnetization of the at least on first magnet and the at least on second magnet, placing the wrist alignment device in contact with the at least one third magnet and the at least one fourth magnet such that the flat planar end comes in contact with the fourth magnet and the side of the oblong body having the inset second magnet comes in contact with the third magnet, and teaching the use of the instrument with the wrist alignment device attached as per above where a portion of the oblong-shaped surface of the device comes in contact with a ball of the player's hand while allowing the wrist to rotate to allow proper placement of the fingers on the fingerboard.

* * * * *